United States Patent [19]

Onari et al.

[11] Patent Number: 4,996,965

[45] Date of Patent: Mar. 5, 1991

[54] ELECTRONIC ENGINE CONTROL METHOD AND SYSTEM FOR INTERNAL COMBUSTION ENGINES

[75] Inventors: Mikihiko Onari, Kokubunji; Motohisa Funabashi, Sagamihara; Teruji Sekozawa, Kawasaki; Takeshi Atago, Katsuta; Makoto Shioya, Tokyo, all of Japan

[73] Assignee: Hitachi, Ltd., Tokyo, Japan

[21] Appl. No.: 420,697

[22] Filed: Oct. 11, 1989

Related U.S. Application Data

[63] Continuation of Ser. No. 155,391, Feb. 12, 1988, abandoned, which is a continuation-in-part of Ser. No. 46,388, May 6, 1987, Pat. No. 4,853,720, which is a continuation-in-part of Ser. No. 92,613, Sep. 3, 1987, Pat. No. 4,887,216.

[30] Foreign Application Priority Data

Feb. 18, 1987 [JP] Japan ..... 62-33256

[51] Int. Cl.[5] ..... F02M 51/00

[52] U.S. Cl. ..... 123/492

[58] Field of Search ..... 123/492, 493, 489, 339, 123/480, 440; 364/431.05, 431.11

[56] References Cited

U.S. PATENT DOCUMENTS

| | | | |
|---|---|---|---|
| 4,408,279 | 10/1983 | Imai et al. | 123/492 |
| 4,469,074 | 9/1984 | Takao et al. | 123/492 |
| 4,508,084 | 4/1985 | Yamato et al. | 123/492 |
| 4,527,529 | 7/1985 | Suzuki et al. | 123/492 |
| 4,552,116 | 11/1985 | Kuroiwa et al. | 123/492 |
| 4,571,683 | 2/1986 | Kobayashi et al. | 123/492 |
| 4,683,860 | 8/1987 | Shimamura et al. | 123/492 |
| 4,690,117 | 9/1987 | Isobe et al. | 123/492 |

FOREIGN PATENT DOCUMENTS

| | | |
|---|---|---|
| 3520050 | 12/1985 | Fed. Rep. of Germany . |
| 2155668 | 9/1985 | United Kingdom . |

OTHER PUBLICATIONS

Patent Abstract of Japan, vol. 10, No. 277 (M-519) [2333], 19th Sep. 1986; & JP-A-61-98 936 (Toyota Motor Corp. 17-05-1986).

Patent Abstracts of Japan, vol. 7, No. 102 (M-211) [1247] 30th Apr. 1983; & JP-A-58 23 240 (Toyota Jidosha Kogyo K.K.) 10-02-1983.

Patent Abstracts of Japan, vol. 11, No. 82 (M-571) [2529], 12th Mar. 1987, p. 94 M 571; & JP-A-61 237 854 (Mazda Motor Corp.) 23-10-1986 (Cat. A).

Systems and Controls, vol. 24, No. 5, pp. 306-312, 1980 (No Month Provided).

*Primary Examiner*—Raymond A. Nelli

*Attorney, Agent, or Firm*—Pennie & Edmonds

[57] ABSTRACT

An electronic control system for an internal combustion engine includes a plurality of first sensors for measuring a driver action taken in accordance with a driver's intent, a plurality of second sensors for measuring operating conditions of an engine, a plurality of actuators for controlling the engine, a unit for setting a target reference by selecting one among a plurality of target references for engine control, and a unit for manipulating the actuators responsive to the established target reference to control the engine.

22 Claims, 12 Drawing Sheets

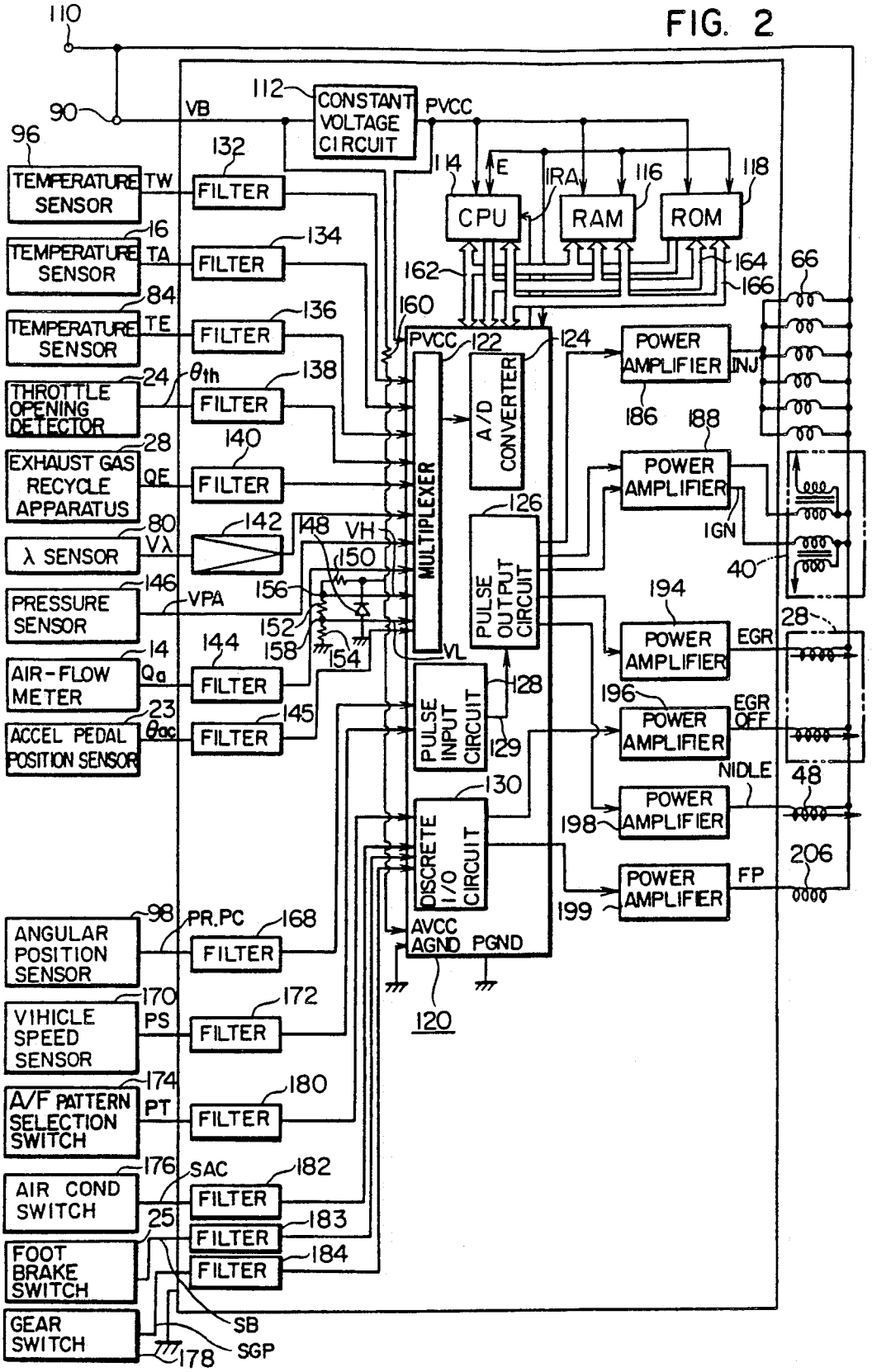
FIG. 2
110
90
VB
112
CONSTANT VOLTAGE CIRCUIT
PVCC
96
TEMPERATURE SENSOR
TW
132
FILTER
16
TEMPERATURE SENSOR
TA
134
FILTER
84
TEMPERATURE SENSOR
TE
136
FILTER
24
THROTTLE OPENING DETECTOR
θth
138
FILTER
28
EXHAUST GAS RECYCLE APPARATUS
QE
140
FILTER
80
λ SENSOR
Vλ
142
146
PRESSURE SENSOR
VPA
14
AIR-FLOW METER
Qa
144
FILTER
23
ACCEL PEDAL POSITION SENSOR
θac
145
FILTER
98
ANGULAR POSITION SENSOR
PR.PC
168
FILTER
170
VIHICLE SPEED SENSOR
PS
172
FILTER
174
A/F PATTERN SELECTION SWITCH
PT
180
FILTER
176
AIR COND SWITCH
SAC
182
FILTER
25
FOOT BRAKE SWITCH
183
FILTER
184
FILTER
GEAR SWITCH
178
SB
SGP
114
CPU
E
IRA
116
RAM
118
ROM
162
164
166
160
PVCC
122
124
MULTIPLEXER
A/D CONVERTER
126
PULSE OUTPUT CIRCUIT
VH
148
150
156
152
158
154
VL
128
PULSE INPUT CIRCUIT
129
130
DISCRETE I/O CIRCUIT
AVCC
AGND
PGND
120
POWER AMPLIFIER
INJ
186
188
POWER AMPLIFIER
IGN
194
POWER AMPLIFIER
EGR
196
POWER AMPLIFIER
EGR OFF
NIDLE
198
POWER AMPLIFIER
199
POWER AMPLIFIER
FP
66
40
28
48
206

FIG. 6

| VEHICLE CONDITION \ DRIVER'S INTENT | | BRAKING $\theta_{br}>0$ $\theta_{ac}=0$ | TRANSIENT · COASTING $\theta_{br}=0$ $\theta_{ac}=0$ | $\theta_{AC}>0$ DECELERATION $\theta_{ac}\leq\dot{\theta}_{acd}$ $N\geq Nd$ | $\theta_{AC}>0$ RUNNING $\dot{\theta}_{acd}<\dot{\theta}_{ac}<\dot{\theta}_{aca}$ | $\theta_{AC}>0$ ACCELERATION $\dot{\theta}_{ac}\geq\dot{\theta}_{aca}$ $N\leq Na$ |
|---|---|---|---|---|---|---|
| REST | TORQUE TRANSMISSION: OFF | 5 IDLE SPEED CONTROL | | 4 A/F CONTROL (RACING) | | |
| REST $v=0$ | ON | MT : — ENGIN STALL<br>AT : ISC | | — | | 1 ACCELERATION CONTROL |
| ACCELERATION RUNNING DECELERATION $v>0$ | ON | 3 FUEL CUT-OFF CONTROL | | 2 DECELERATION CONTROL | 4 A/F CONTROL (CRUISING CONTROL SELECTION) | |

$\theta_{ac}$ : ACCELERATOR PEDAL ANGLE
$\dot{\theta}_{ac}$ : ACCELERATION RATE
$\theta_{br}$ : BRAKE PEDAL ANGLE
$v$ : VEHICLE SPEED
N : ENGINE SPEED
AFFIXED a : CONSTANT RELATING TO ACCELERATION
AFFIXED d : CONSTANT RELATING TO DECELERATION

ELECTRONIC ENGINE CONTROL METHOD AND SYSTEM FOR INTERNAL COMBUSTION ENGINES

This is a continuation of application Ser. No. 07/155,391, filed Feb. 12, 1988, now abandoned, which is a continuation-in-part of (1) application Ser. No. 46,388, filed May 6, 1987, entitled "Condition Adaptive-Type Control Method for Internal Combustion Engines", which issued on Aug. 1, 1989 as U.S. Pat. No. 4,853,720; and (2) application Ser. No. 092,613, filed Sept. 3, 1987, U.S. Pat. No. 4,887,216, entitled "Method of Engine control Timed to Engine Revolution".

BACKGROUND OF THE INVENTION

The present invention relates to an electronic control method and system for internal combustion engines and more particularly to a control method and system well suited to smoothly effect the engine control under all operating conditions.

In the past, an engine control system of the type employing a CPU (central processing unit) as an electronic engine control unit to control an engine has been disclosed, for example, in "Systems and Controls", vol 24, No. 5, p.p. 306–312, 1980.

In this case, a method of determining the actual fuel injection quantity $Q_f$ by adding various corrections to a basic fuel injection quantity determined on the basis of an intake air flow rate $Q_a$ and an engine speed N is used. In this system, the respective correction factor are determined on the basis of the actual car tests and they are determined to take the form of values incorporating the results of feeling evaluations.

The air-fuel ratio $(A/F)_A$ of the exhaust gas is measured by an $O_2$ sensor so as to determined whether the calculated fuel injection quantity $Q_f$ has resulted in the optimum combustion. This determination is effected unifiedly under all operating conditions and the value of $Q_f$ is feedback controlled in accordance with the deviation of the measured air-fuel ratio $(A/F)_A$ from the desired air-fuel ratio $(A/F)_R$.

The operation program for executing the above-mentioned processing is started in accordance with a time interval and a degree of engine crankshaft rotation. This means that the control is effected by noting only the average movements of the air and fuel drawn into the engine and the exhaust gas.

The above-mentioned prior art techniques have given no consideration to the setting up of a target reference, the updating of calculation models for fuel injection quantity and ignition timing, the measurement of the flow of clusters of gases having bearing on the combustion, etc., and thus they are disadvantageous in terms of economy (fuel consumption) driveability and riding comfort.

Moreover, the conventional control methods have noted the average movements of an engine thus failing to accurately grasp the combustion in each cylinder and thereby making it impossible to properly control the combustion in each cylinder separately.

SUMMARY OF THE INVENTION

It is an object of the present invention to provide a control method and system designed so that in accordance with each operating condition of an engine a target reference is set up and the engine is controlled so as to satisfy the target reference.

As the target reference, a physical quantity representing the operating condition of the engine, such as, the driveability or riding comfort of the vehicle, the exhaust gas characteristic or the like is selected. Also, the target reference is set up in accordance with the conditions of the vehicle and the driver's intent or preference. In addition, its set values are updated in accordance with the driving environment or conditions. In accordance with the control method, the intent of the driver is detected in accordance with the accelerator pedal angle ($\theta_{ac}$) so that the desired fuel injection quantity is predictively calculated in a feed-forward manner in accordance with the current intake air flow rate and engine speed and also a predictive calculation model is updated on the basis of the combustion result.

It is another object of the invention to provide such control method and system capable of properly grasping the combustion in each cylinder of an engine.

More specifically, the amount of intake air and the quantity of fuel supplied to each cylinder are measured and the correspondence between them and their combustion result or the exhaust gas is identified properly. Thus, in accordance with the invention the clusters of gases having bearing on the combustion are tracked.

To accomplish the above objects, in accordance with the present invention there is thus provided an engine control system which is roughly divided into a section for selectively setting up a plurality of target references and a section responsive to the set target reference to control the engine. Preferably, each of the sections discriminates and categorizes various operating conditions of the engine, prepare a target reference and control model for each of the operating conditions of the engine and update selectively these target references and control models. Hereinafter, the expression, "the operating condition of the engine", is abbreviated as "the operating condition".

In accordance with categories respectively determined on the basis of the operating conditions and the preferences of the driver, the target references may each be represented in the form of an air-fuel ratio-load graph (air-fuel ratio pattern) determined in consideration of the exhaust gas emission regulation and the driving safety and riding comfort.

The operating conditions are discriminated and categorized on the basis of various conditions of the vehicle and the driver's intents.

The condition of the vehicle can be detected in accordance with the vehicle speed and variation of the vehicle speed. The driver indicates his intent on the running by coupling the torque transmission mechanism (the clutch and the transmission) and depressing the brake pedal or the accelerator pedal. In other words, by selectively depressing the two pedals, the driver indicates his intent corresponding to the conditions of the vehicle and the surrounding condition. The angles and angular velocities of the pedals and their time serial trajectories indicate the driver's intents.

In accordance with the vehicle speed and its time variation and the measured values of the angles and angular velocities of the pedals from the past up to the present, the conditions of the vehicle and the intents of the driver can be detected in detail. In addition, by utilizing these data, it is possible to deduce the conditions of the vehicle and the driver's intent and thereby to predict the future condition of the vehicle.

The driver's preferences must be realized in terms of variations in the dynamic characteristic, e.g., acceleration pattern of the vehicle. This can be dealt with by changing the setting of the A/F desired values. The driver's preferences are classified into operating modes, such as, sporty, comfortable and economy modes and an air-fuel ratio-load pattern is prepared in correspondence to each of the modes. The load may specifically be replaced by the throttle valve opening.

The predictive calculation model for calculating the fuel injection quantity is updated to suit the current vehicle condition by using the measured values or estimated values of the intake air flow rate, the intake fuel quantity and the air-fuel ratio indicative of the combustion result which have bearing on the combustion in each cylinder. The measurement of the clusters of gases, e.g., air, fuel and exhaust gas having bearing on the combustion in each cylinder is effected synchronously in accordance with given crank angles in consideration of the delays in transfer of the gases due to the flow of the inflowing and outflowing gases and the positions of sensors for measuring the gases for each cylinder.

BRIEF DESCRIPTION OF THE DRAWINGS

FIG. 2 shows in detail the structure of the control circuit shown in FIG. 1;

FIG. 6 is a diagram showing the relation between the conditions of the vehicle and the driver's intents and the respective engine control methods;

DESCRIPTION OF THE PREFERRED EMBODIMENTS

Figure 1:
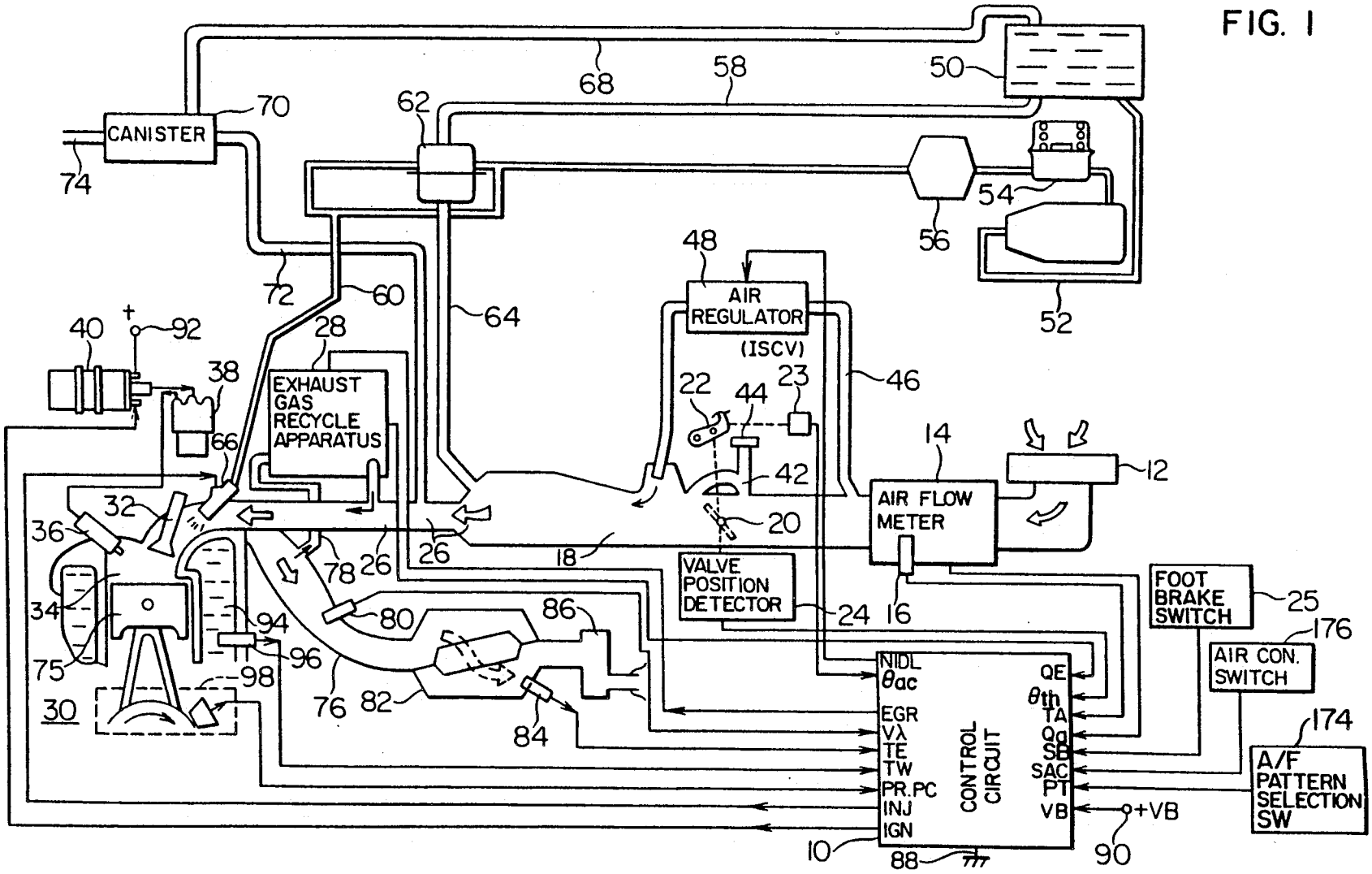
FIG. 1 is a diagrammatic view showing the structure of a typical example of an electronic engine control system to which the present invention is applied.

The electronic engine control system according to the present invention will now be described by way of embodiment with the aid of accompanying drawings. FIG. 1 systematically shows a typical example of the structure of an electronic engine control system according to the present invention. Air sucked through an air cleaner 12 is passed through an air flow meter 14 to measure the flow rate thereof, and the air flow meter 14 delivers an output signal $Q_a$ indicating the flow rate of air to a control circuit 10. A temperature sensor 16 is provided in the air flow meter 14 so as to detect the temperature of the sucked air, and the output signal TA of the sensor 16, indicating the temperature of the sucked air, is also supplied to the control circuit 10.

The air flowing through the air flow meter 14 is further passed through a throttle chamber 18, an intake manifold 26 and a suction valve 32 to the combustion chamber 34 of an engine 30. The quantity of air inhaled into the combustion chamber 34 is controlled by changing the opening of a throttle valve 20 provided in the throttle chamber 18. The opening of the throttle valve 20 is detected by detecting the valve position of the throttle valve 20 by a throttle valve position detector 24, and a signal $\theta$th representing the valve position of the throttle valve 20 is supplied from the throttle valve position detector 24 to the control circuit 10. The position of an accelerator pedal 22 representing the amount of depression (angle) thereof is detected by an accelerator pedal position sensor 23 which in turn delivers a signal $\theta$ac representing the depression angle of the pedal 22 to the control circuit 10. The opening of the throttle valve 20 is controlled by the accelerator pedal 22.

The throttle chamber 18 is provided with a bypass 42 for idling operation of the engine and an idle adjust screw 44 for adjusting the flow of air through the bypass 42. When the throttle valve 20 is completely closed, the engine operates in the idling condition. The sucked air from the air flow meter 14 flows via the bypass 42 and is inhaled into the combustion chamber 34. Accordingly, the flow of the air sucked under the idling condition is changed by adjusting the idle adjust screw 44. The energy created in the combustion chamber 34 is determined substantially depending on the flow rate of the air inhaled through the bypass 42 so that the rotation speed of the engine under the idling condition can be adjusted to an optimal one by controlling the flow rate of air inhale into the combustion chamber 34 by adjusting the idle adjust screw 44.

The throttle chamber 18 is also provided with another bypass 46 and an air regulator 48 including an idle speed control valve (ISCV). The air regulator 48 controls the flow rate of the air through the bypass 46 in accordance with an output signal NIDL of the control circuit 10, so as to control the rotation speed of the engine during the warming-up operation and to properly supply air into the combustion chamber at a sudden change in, especially sudden closing of, the valve position of the throttle valve 20. The air regulator 48 can also change the flow rate of air during the idling operation.

Next, the fuel supply system will be described. Fuel stored in a fuel tank 50 is pumped out to a fuel damper 54 by means of a fuel pump 52. The fuel damper 54 absorbs the pressure undulation of the fuel supplied from the fuel pump 52 so that fuel having a constant pressure can be supplied through a fuel filter 56 to a fuel pressure regulator 62. The fuel fed past the fuel pressure regulator 62 is supplied under pressure to a fuel injector 66 fuel pipe 60 and output signal INJ of the control circuit 10 causes the fuel injector 66 to inject the fuel into the intake manifold 26.

The quantity of the fuel injected by the fuel injector 66 is determined by the period for which the fuel injector 66 is opened and by the difference between the pressure of the fuel supplied to the injector and the pressure in the intake manifold 26 in which the pressurized fuel is injected. It is however preferable that the quantity of the injected fuel should depend only on the period for which the injector is opened and which is determined by the signal supplied from the control circuit 10. Accordingly, the pressure of the fuel supplied by the fuel pressure regulator 62 to the fuel injector 66 is controlled in such a manner that the difference between the pressure of the fuel supplied to the fuel injector 66 and the pressure in the intake manifold 26 is kept always constant in any driving condition. The pressure in the intake manifold 26 is applied to the fuel pressure regulator 62 through a pressure conducting pipe 64. When the pressure of the fuel in the fuel pipe 60 exceeds the pressure setting of the regulator 62 by a predetermined level, the fuel pipe 60 communicates with a fuel return pipe 58 so that the excessive fuel corresponding to the excessive pressure is returned through the fuel return pipe 58 to the fuel tank 50. Thus, the difference between the pressure of the fuel in the fuel pipe 60 and the pressure in the intake manifold 26 is kept always constant.

The fuel tank 50 is also provided with a pipe 68 connected to a canister 70 provided for the suction of atomized fuel or fuel gas. When the engine is operating, air is sucked through an open air inlet 74 to supply the fuel gas into the intake manifold 26 and therefore into the engine 30 via a pipe 72. When the engine is stopped, the fuel gas is exhausted through activated carbon filled in the canister 70.

As described above, the fuel is injected by the fuel injector 66, the suction valve 32 is opened in synchronism with the motion of a piston 75, and a mixture gas of air and fuel is sucked into the combustion chamber 34. The mixture gas is compressed and fired by the spark generated by an ignition plug 36 so that the energy created through the combustion of the mixture gas is converted to mechanical energy.

The exhaust gas produced as a result of the combustion of the mixture gas is discharged into the open air through an exhaust valve (not shown), an exhaust pipe 76, a catalytic converter 82 and a muffler 86. The exhaust pipe 76 is provided with an exhaust gas recycle pipe 78 (hereafter referred to for short as an EGR pipe), through which part of the exhaust gas is guided into the intake manifold 26, that is, part of the exhaust gas is circulated to the suction side of the engine. The quantity of the circulated exhaust gas is determined depending on the opening of the valve of an exhaust gas recycle apparatus 28. The valve opening is controlled by an output signal EGR of the control circuit 10, and the valve position of the apparatus 28 is converted into an electric signal QE to be supplied as an input to the control circuit 10.

A $\lambda$ sensor 80 is provided in the exhaust pipe 76 to detect the fuel-air mixture ratio of the mixture gas sucked into the combustion chamber 34. An oxygen sensor ($O_2$ sensor) is usually used as the $\lambda$ sensor 80 and detects the concentration of oxygen contained in the exhaust gas so as to generate a voltage signal $V_\lambda$ corresponding to the concentration of the oxygen contained in the exhaust gas. The output signal $V_\lambda$ of the $\lambda$ sensor 80 is supplied to the control circuit 10. The catalytic converter 82 is provided with a temperature sensor 84 for detecting the temperature of the exhaust gas in the converter 82, and the output signal TE of the sensor 84 corresponding to the temperature of the exhaust gas in the converter 82 is supplied to the control circuit 10.

The control circuit 10 has a negative power source terminal 88 and a positive power source terminal 90. The control circuit 10 supplies the signal IGN for causing the ignition plug 36 to spark, to the primary winding of an ignition coil 40. As a result, a high voltage is induced in the secondary winding of the ignition coil 40 and supplied through a distributor 38 to the ignition plug 36 so that the plug 36 fires to cause the combustion of the mixture gas in the combustion chamber 34. The mechanism of firing the ignition plug 36 will be further detailed. The ignition plug 36 has a positive power source terminal 92, and the control circuit 10 also has a power transistor for controlling the primary current through the primary winding of the ignition coil 40. The series circuit of the primary winding of the ignition coil 40 and the power transistor is connected between the positive power source terminal 92 of the ignition coil 40 and the negative power source terminal 88 of the control circuit 10. When the power transistor is conducting, electromagnetic energy is stored in the ignition coil 40, and when the power transistor is cut off, the stored electromagnetic energy is released as a high voltage to the ignition plug 36.

The engine 30 is provided with a temperature sensor 96 for detecting the temperature of the water 94 circulated as a coolant in the water jacket, and the temperature sensor 96 delivers to the control circuit 10 a signal TW representing the temperature of the water 94. The engine 30 is further provided with an angular position sensor 98 for detecting the angular position of the rotary shaft of the engine, and the sensor 98 generates a reference signal PR in synchronism with the rotation of the engine, e.g. every 120° of the rotation, and an angular position signal PC each time the engine rotates through a constant, predetermined angle (e.g. 0.5°). The reference signal PR and the angular position signal PC are both supplied to the control circuit 10.

A foot brake switch 25 detects the position of a foot brake (not shown) and delivers a signal SB to the control circuit 10 when the foot brake is depressed. An air conditioner switch 176 delivers a signal SAC indicating the ON state of an air conditioner to the control circuit 10.

FIG. 2 shows in detail the structure of the control circuit 10 shown in FIG. 1. The positive power source terminal 90 of the control circuit 10 is connected with the positive electrode 110 of a battery to provide a voltage VB for the control circuit 10. The power source voltage VB is adjusted to a constant voltage PVCC of, for example, 5 volts by a constant voltage circuit 112. This constant voltage PVCC is applied to a central processor unit 114 (hereafter referred to as a CPU), a random access memory 116 (hereafter referred to as a RAM) and a read-only memory 118 (hereafter referred to as a ROM). The output voltage PVCC of the constant voltage circuit 112 is supplied also to an input/output circuit 120.

The input/output circuit 120 includes therein a multiplexer 122, an analog-digital converter 124, a pulse output circuit 126, a pulse input circuit 128 and a discrete input/output circuit 130.

The multiplexer 122 receives plural analog signals, selects one of the analog signals in accordance with the instruction from the CPU, and applies the selected signal to the A/D converter 124. The analog signal inputs applied through filters 132 to 145 to the multiplexer 122 are the outputs of the various sensors shown in FIG. 1; the analog signal TW from the sensor 96 representing the temperature of the cooling water in the water jacket of the engine, the analog signal TA from the sensor 16 representing the temperature of the sucked air, the analog signal TE from the sensor 84 representing the temperature of the exhaust gas, the analog signal $\theta$th from the throttle opening detector 24 representing the opening of the throttle valve 20, the analog signal QE from the exhaust recycle apparatus 28 representing the opening of the valve of the apparatus 28, the analog signal $V_\lambda$ from the λ sensor 80 representing the air-excess rate of the sucked mixture of fuel and air, the analog signal Qa from the air flow meter 14 representing the flow rate of air, and the analog signal $\theta_{ac}$ from the accelerator pedal position sensor 23 representing the depression angle of the accelerator pedal. The output signal $V_\lambda$ of the λ sensor 80 described above is supplied through an amplifier 142 with a filter circuit to the multiplexer 122.

An analog signal VPA from an atmospheric pressure sensor 146 representing the atmospheric pressure is also supplied to the multiplexer 122. The voltage VB is applied from the positive power source terminal 90 to a series circuit of resistors 150, 152 and 154 through a resistor 160. The series circuit of the resistors 150, 152 and 154 is shunt with a Zener diode 148 to keep the voltage across it constant. To the multiplexer 122 are applied the voltages VH and VL at the junction points 156 and 158 respectively between the resistors 150 and 152 and between the resistors 152 and 154.

The CPU 114, the RAM 116, the ROM 118 and the input/output circuit 120 are interconnected respectively by a data bus 162, an address bus 164 and a control bus 166. A clock signal E is supplied from the CPU to the RAM, ROM and input/output circuit 120, and the data transfer take place through the data bus 162 in timing with the clock signal E.

The multiplexer 122 in the input/output circuit 120 receives as its analog inputs the signals representing the cooling water temperature TW, the temperature TA of the sucked air, the temperature TE of the exhaust gas, the throttle valve opening θth, the quantity QE of recycle exhaust gas, the output $V_\lambda$ of the λ sensor, the atmospheric pressure VPA, the quantity Qa of the sucked air, the quantity $\Theta_{ac}$ of the accelerator angular position, and the reference voltages VH and VL. The CPU 114 specifies the address of each of these analog inputs through the address bus 164 in accordance with the instruction program stored in the ROM 118, and the analog input having a specified address is taken in. The analog input taken in is applied through the multiplexer 122 to the analog/digital converter 124, and the output of the converter 124, i.e. the A/D converted value, is held in the associated register. The stored value is supplied, if desired, to the CPU 114 or RAM 116 in response to the instruction sent from the CPU 114 through the control bus 166.

The pulse input circuit 128 receives as inputs the reference pulse signal PR and the angular position signal PC both in the form of a pulse train from the angular position sensor 98 through a filter 168. A pulse train of pulses PS having a repetition frequency corresponding to the speed of the vehicle is supplied from a vehicle speed sensor 170 to the pulse input circuit 128 through a filter 172. The signals processed by the CPU 114 are held in the pulse output circuit 126. The output of the pulse output circuit 126 is applied to a power amplifying circuit 186, and the fuel injector 66 is controlled by the output signal of the power amplifying circuit 186.

Power amplifying circuits 188, 194 and 198 respectively control the primary current of the ignition coil 40, the valve opening of the exhaust recycle apparatus 28 and the valve opening of the air regulator 48 in accordance with the output pulses of the pulse output circuit 126. The discrete input/output circuit 130 receives a signal SAC from the air conditioner switch 176, a signal SB from the foot brake switch 25 and a signal SGP from a gear switch 178 indicating the transmission gear position (this switch is not provided in an automobile of automatic transmission type), respectively through filters 182, 183 and 184 holds the signals. The discrete input/output circuit 130 also receives and holds the processed signals from the CPU 114. The discrete input/ output circuit 130 processes the signals the content of each of which can be represented by a single bit. In response to the signal from the CPU 114, the discrete input/output circuit 130 applies signals to the power amplifying circuits 196 and 199 so that the exhaust recycle apparatus 28 is closed to stop the recycle of exhaust gas and the fuel pump is controlled.

As described hereinabove, in accordance with the invention the combustion in each cylinder is grasped accurately, and thus the intake air quantity and the fuel injection quantity to each cylinder are measured to accurately identify the correspondence between these quantities and the exhaust gas produced as the result of their combustion. For this purpose, the clusters of gases, e.g., the air, fuel and exhaust gas having bearing on the combustion ar tracked.

To collect the data corresponding to the combustion in each cylinder, the intake air quantity is measured at the time of the maximum down stroke rate of the cylinder piston and the speed involving the explosion cycle (calculated in terms of a time of crank angle movement) is measured as the engine speed. By thus making the measurements carefully in correspondence to each combustion cycle, it is possible to measure the properly corresponding physical quantities.

The timings of the data input and calculations relating to the combustion will now be described with reference to FIGS. 3 to 5.

Figure 3:
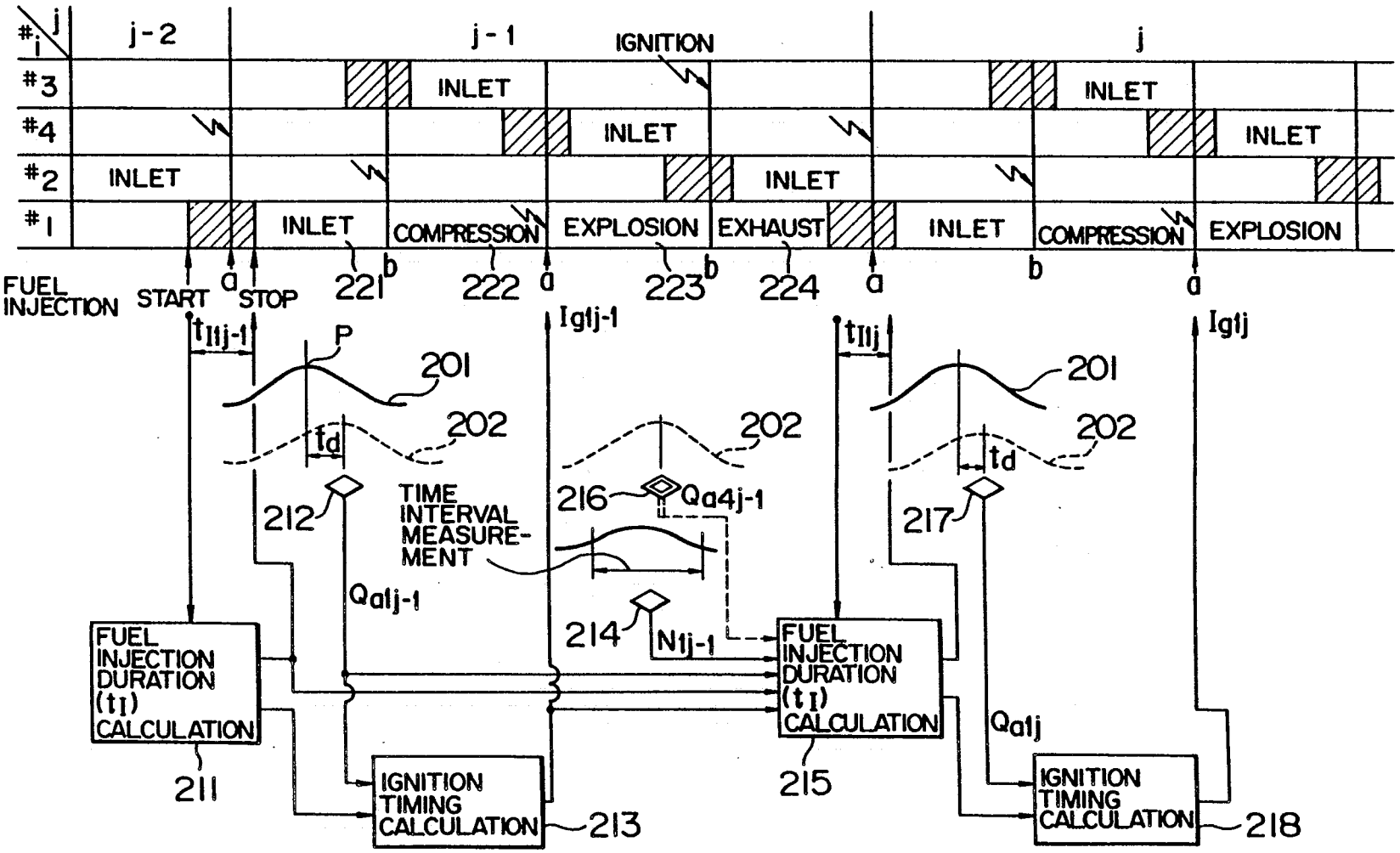
FIG. 3 is a time chart showing timings of input and calculation of data.

FIG. 3 shows the cycles of a four-cylinder engine, and the timings of the input of data, the calculation of a fuel injection duration ($t_I$) and the calculation of an ignition timing which are performed in synchronism with the cycles (exactly, crank angle positions measured by the sensor 98 in FIG. 1). FIG. 4 shows the crank angle (hereinafter referred to CA) positions with reference to the top dead center in the inlet and compression cycles of a certain cylinder.

Cylinder #1 will be referred to in the description. The calculation 211 of the fuel injection duration ($t_I$) is started with the start of fuel injection (the opening of the injector) at a fixed crank angle before a TDC a, and it evaluates a fuel injection duration period $t_{I1j-1}$. When the period has lapsed, the fuel injection is ended. Injected fuel is drawn by suction into the cylinder along with air in the next inlet cycle 221. An air volume ($Q_{a1j-1}$) 212 drawn by this process is measured by the air flow meter 14 or the like. The inlet air volume is measured at a point of time which is a measurement delay time $t_d$ later than a crank angle position corresponding to a position intermediate between the top dead center a and a bottom dead center b (C°CA in FIG. 4, corresponding to a point at which the descending speed of a piston is the highest).

The inlet air volume can be measured by integrating the air flow drawn by suction into the cylinder. It is difficult, however, to detect the timings of the start and end of the suction. An effective countermeasure against this difficulty is that while the variation of the inlet air volume is being monitored, the peak value thereof is searched for, whereupon the inlet air volume drawn into the cylinder is presumed from the peak value and the revolution number per unit time of the engine (engine speed). When such a measuring method is adopted, the delay time $t_d$ attributed to the velocity lag of the air between the cylinder and a measuring point where the air flow meter 2 is located, can be compensated in terms of a corresponding crank angle. In FIG. 3, a curve 201 indicates the variation of the air volume which is actually drawn into the cylinder, while a curve 202 indicates the variation of the air volume which is measured.

The fuel injected for the duration $t_{fij-1}$ and the inlet air volume measured as the above value $Q_{aij-1}$ are both drawn into the cylinder, to generate a torque in an explosion cycle 223.

A required torque can be predicted from a throttle opening angle and an operating condition of the engine. An ignition timing $I_{gij-1}$ is determined and adjusted by the ignition timing calculation 213 so that the combustion of the air volume and the fuel volume already existing in the cylinder may produce the required torque.

The torque generated according to the values $t_{fij-1}$, $Q_{aij-1}$ and $I_{gij-1}$ changes the engine speed. The engine speed $N_{ij-1}$ at that time can be determined by the inverse number of a moving time interval measured between two CA positions corresponding to an explosion duration (between A°CA and E°CA in FIG. 4). The engine speed $N_{ij-1}$ thus measured contains also an engine speed increment which has been increased by the current explosion cycle. The engine speed increment ca be utilized for identifying the combustion control characteristic of the engine.

In the above, the sequence of the fuel injection volume calculation, the inlet air volume measurement, the ignition timing calculation and the engine speed measurement has been described with the lapse of time. With this sequence, however, it is not ensured that the fuel injection volume be at a ratio corresponding to the inlet air volume, in other words, that a required air/fuel ratio (hereinbelow, abbreviated to "A/F") be established. Therefore, the fuel injection volume needs to be corrected by the ignition timing calculation so as to generate the required torque.

From the aspects of fuel economy and engine vibration prevention, the fuel injection volume should desirably be determined relative to the inlet air volume so as to establish the required A/F. However, the fuel injection volume must be determined before the measurement of the inlet air volume. The prior art has used the measured value of the past inlet air volume without taking into consideration which of the cylinders it was obtained from. In the present invention, with note taken of the correspondence between the generated torque and the fuel and air volumes of each cylinder, the combustion characteristic of each cylinder is identified, whereupon an operating condition of the engine is grasped. Further, the intention of a driver is presumed. Then, an appropriate fuel injection volume is determined. Regarding a deviation from the predictive presumption, the correction is finally made by the ignition timing calculation.

The calculation of the identification, in a fuel injection duration ($t_1$) calculation 215 in the current process j, uses as inputs the fuel injection duration period $t_{fij-1}$ obtained by the $t_f$ calculation 211 in the last process (j−1), the measured value 212 of the inlet air volume ($Q_{aij-1}$), the ignition timing $I_{gij-1}$) obtained by the ignition timing calculation 213 and the measured value 214 of the engine speed ($N_{ij-1}$), and identifies the combustion characteristic (the generated torque depending upon the A/F and the ignition angle) of the pertinent cylinder (#1 in the present example). Subsequently, a fuel injection duration period $t_{fij}$ in the current process j is calculated to set the end point of time of fuel injection, on the basis of a combustion characteristic in which the time-serial change of the characteristic of the particular cylinder is also considered, and with notice taken of the newest intention of the driver which is known from the measured value 216 ($Q_{a4j-1}$) of the inlet air volume of another cylinder nearest to the inlet cycle of the particular cylinder. Thereafter, the measured value 217 ($Q_{aij}$) of the inlet air volume of the particular cylinder is obtained. In a case where it deviates from the presumed air volume, an ignition timing $I_{gij}$ corresponding to the deviation is calculated and set in an ignition timing calculation 218.

The steps of the above calculations will be described more in detail. When crank angle position signals are input to the control circuit in correspondence with the positions A–G of the crank angle shown in FIG. 4, computer programs for processes corresponding to the respective crank angle positions are executed by a sequence in FIG. 5.

Figure 4:
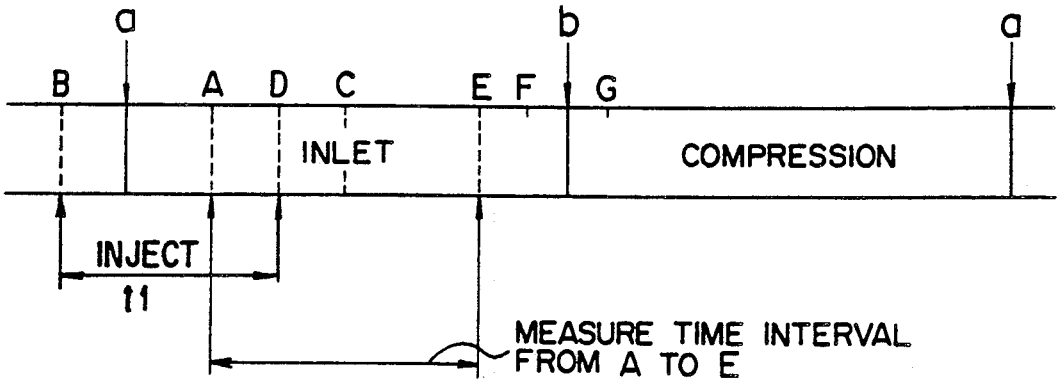
FIG. 4 is a diagram showing the positions of a crank angle in an inlet cycle et seq. with reference to the top dead center of one cylinder.

In FIG. 4, the crank angle positions taken with reference to the top dead center a of the inlet cycle have the following significances:

A°CA: Starting point of measurement for counting engine speed

B°CA: Starting point of fuel injection

C°CA: Middle point between top dead center and bottom dead center

D°CA End point of fuel injection

E°CA: End point of measurement for counting engine speed

F°CA: Output of ignition signal

G°CA: Starting point of measurement of exhaust gas

The operation of a program will be described with reference to FIG. 5. This program is adapted to start a corresponding one of predetermined subprograms either when the crank angle has come to a certain fixed position or when the value of a software timer started within the program has reached a certain value. In addition, the program is so constructed as to monitor the crank angle positions and timers at all times.

When the position A°CA has been reached, a software timer A is started in a block 301. The timer A is stopped in a block 310 when the position E°CA has been reached, a time interval elapsed meantime is measured in a block 311, and the engine speed is calculated in a block 312.

When the position B°CA has been reached, a software timer B is started in a block 302, while at the same time the fuel injection is started by delivering an output signal INJ in a block 303. The point of time till which fuel is injected, is found by the fuel injection volume ($t_f$) calculation in a block 304.

When it is decided in a block 331 that the timer B has coincided with $t_f$ fuel injection is ended by stopping the output signal INJ in a block 305.

When the position C°CA has been reached, a software timer C is started in a block 306, and the velocity lag $t_c$ of the inlet air volume $Q_a$ is calculated in a block 307 from the engine speed N at that time and a constant $K_c$. When it is decided in a block 332 that the value of the timer C has become $t_c$, the inlet air volume $Q_a$ is measured in a block 308. Besides, using this value $Q_a$, the ignition timing F°CA is calculated in a block 309. At the position F°CA, the ignition signal is output in a block 313.

When the position G°CA has been reached beyond the bottom dead center b, a software timer D is started in a block 314 in order to measure the exhaust gas, and the velocity lag $t_g$ of the exhaust gas is calculated from the engine speed N and a constant $K_g$ in a block 315.

When it is decided in a block 333 that the timer D has coincided with $t_g$, the exhaust gas is measured in a block 316. Using the measured result, the adaptive calculation of target reference for A/F control is performed in a block 317, and an EGR (exhaust gas recirculation) control calculation is performed to provide an output in a block 318.

Figure 5:
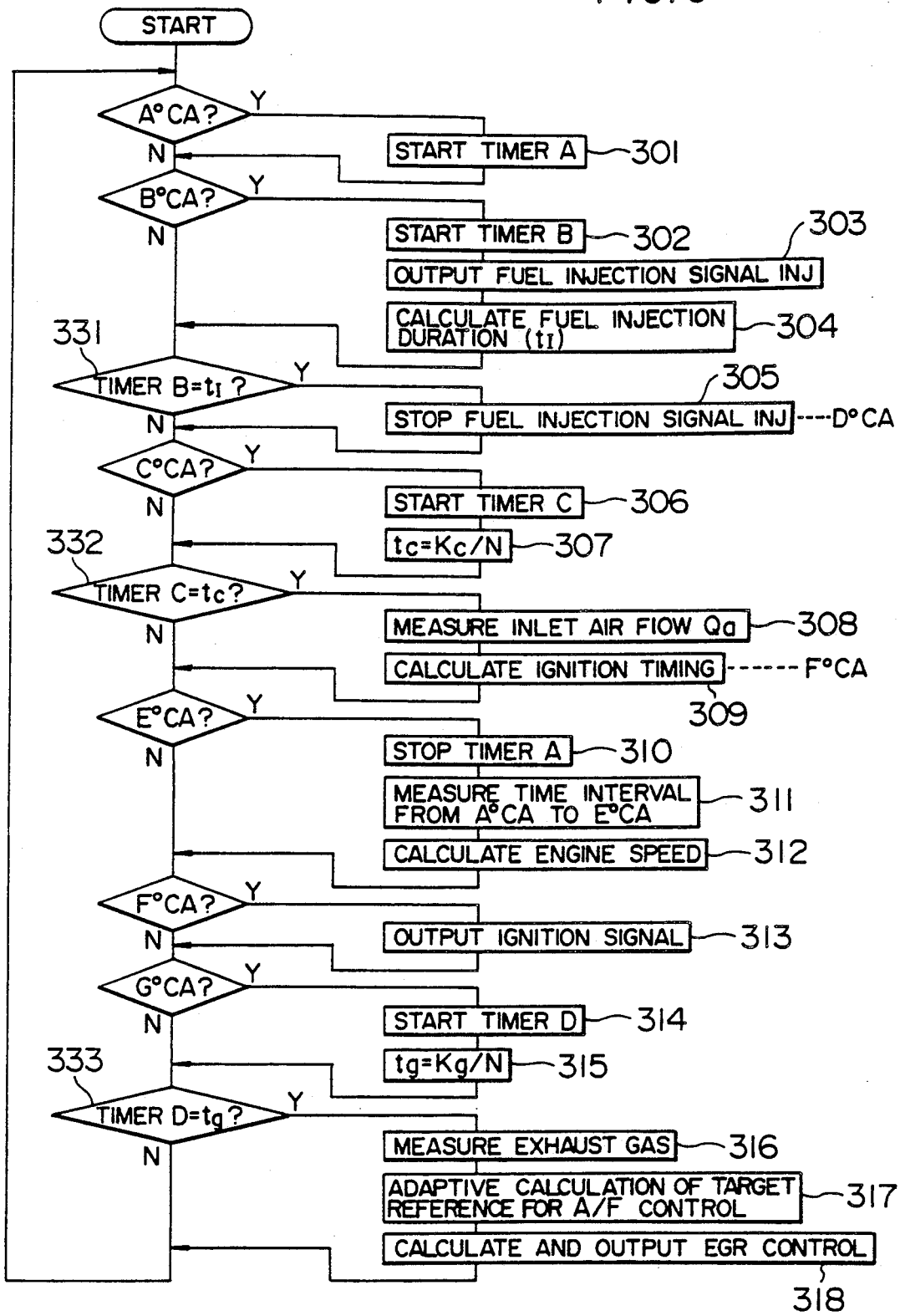
FIG. 5 is a flow chart illustrative of control steps of input and calculation of data shown in FIG. 3.

Although the illustration of FIGS. 4 and 5 has concerned the single cylinder, the same is carried out for the other cylinders. Besides, the multi-point injection (MPI) wherein the fuel injectors are mounted on the respective cylinders is premised in the above description, but even in case of single-point injection (SPI) wherein a single injector is mounted on a manifold, this method can be applied merely by altering the timing and duration period of the fuel injection.

Regarding the measurement of the inlet air volume, the example employing the air flow meter has been described, but a pressure sensor (not shown) is sometimes used instead of the air flow meter 14. Also in the case of using the pressure sensor for the measurement of the inlet air volume, likewise to the case of using the air flow sensor, the peak value (the smallest value) of a manifold pressure is measured, and the measured value is deemed the typical value of the inlet air volume, whereby the inlet air volume can be calculated.

According to this method, phenomena arising with the speed of an engine are measured in accordance with crank angle positions, and computer programs are started synchronously to the crank angle positions, thereby to perform the controls of fuel injection and an ignition timing. Therefore, the physical phenomena can be precisely grasped, and the enhancement of the control performance and the prevention of the vibrations of the engine are attained. Further, it is facilitated to construct a control system and to match control parameters, and in turn, the enhancement of economy can be attained. The reason is that variables concerning the individual combustion cycle of the engine at any engine speed are measured so as to permit the identification of a combustion characteristic, so whether or not the control system or a matched result is proper can be estimated at each engine speed.

In the control of the engine, it is sometimes the case that the combustion states of respective cylinders differ to generate ununiform torques. According to the present invention, the differences of the cylinders can also be detected with ease, and the riding quality of an automobile can be improved. Also, as described hereinabove, in accordance with the present invention, the engine controller or the engine controlling program is roughly divided into the target reference setting section and the control section and the various operating conditions are discriminated and categorized, thereby preparing a target reference and control model for each of the operating conditions. The operating conditions are discriminated and categorized according to the vehicle conditions and the driver's intents.

FIG. 6 shows the operating conditions discriminated and categorized in this way. The operating conditions may be represented in terms of the corresponding engine control methods.

The conditions of the vehicle are roughly divided into a rest condition and a running condition. The driver's intents are discriminated on the basis of six different driver actions including the engaging or disengaging of the torque transmission mechanism, the depression of the brake pedal, non-depression of the brake pedal and the accelerator pedal, the depression of the accelerator pedal, the depressed accelerator pedal at rest and the restored accelerator pedal.

When the torque transmission mechanism is on (engaged) and the accelerator pedal is depressed, an engine control for the acceleration requirement is performed. With the vehicle running, when the accelerator pedal is released and the brake pedal is depressed, a deceleration control is performed. At this time, when the accelerator pedal is released and the engine speed is excessively high, a fuel cut-off control is performed. In order to discriminate between the deceleration control and the fuel cut-off control, the engine speed is detected as a additional parameter.

In the running condition, if the vehicle is neither accelerated nor decelerated, an air-fuel ratio control is performed to maintain the air-fuel ratio at a desired value. Now, the depression and release of the brake pedal can be discriminated by the signal SB from the foot brake switch 25.

When the torque transmission mechanism is off, an idle speed control comes into action to control the engine speed to maintain it at a desired value. At this time, if the accelerator pedal is depressed, the switching to the previously mentioned air-fuel ratio control is effected despite the engine is racing.

The method of discriminating and classifying the conditions of the vehicle and the intents of the driver to select the proper engine control method (operating condition) is well suited to progressively deal with the diverse requirements of the user of the vehicle and the introduction of new techniques which meet the requirements. To the design and development engineer as well as persons who attend matching of the engine control methods with the actual vehicle (the adjustment of the parameters), this means advantages that it is necessary to understand only the engine control methods corresponding to the required categories, that a modification of the computer program requires only the modification of some modules and so on.

Next, an embodiment of the invention will now be described in detail with reference to the accompanying drawings.

Figure 7:
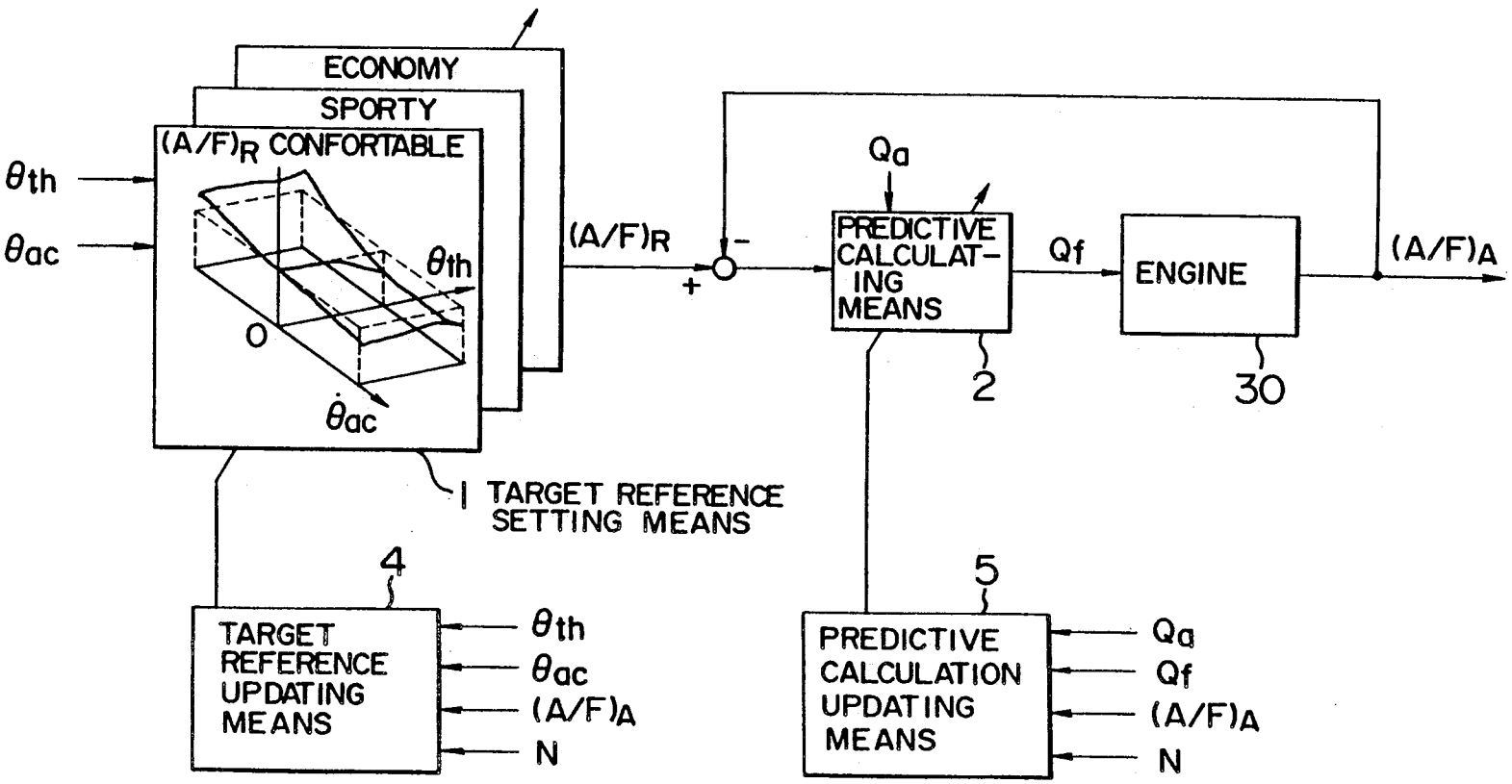
FIG. 7 is a block diagram showing the A/F servo controller in the first embodiment of the invention.
Figure 9:
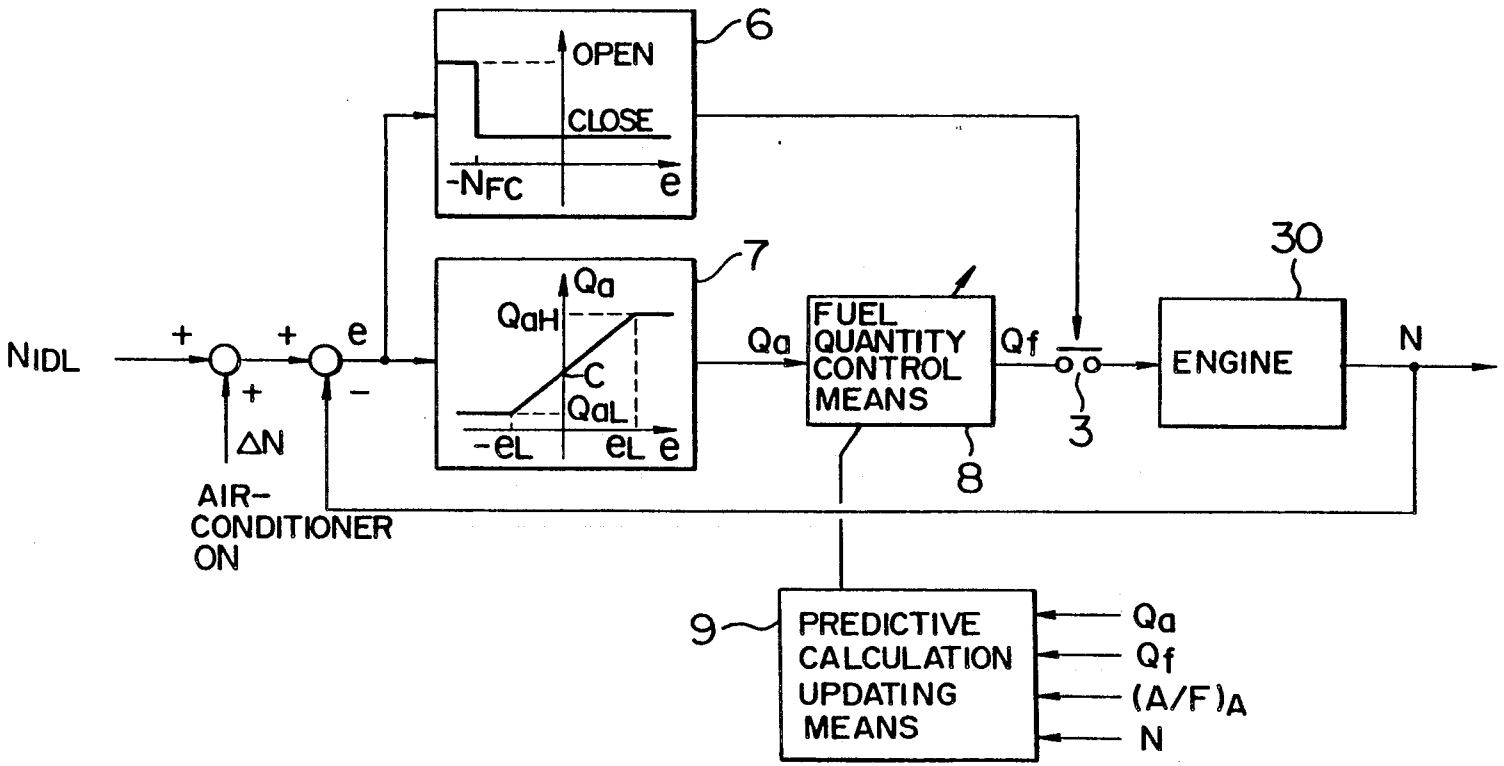
FIG. 9 is a block diagram showing the engine speed servo controller in the first embodiment of the invention.

FIGS. 7 and 9 are block diagrams for the embodiment respectively showing in block form the functions performed by the control circuit 10 shown in FIGS. 1 and 2.

As previously described with reference to FIG. 6, in accordance with the invention the operating conditions can be discriminated depending on whether the accelerator pedal angle $\theta ac$ is positive or zero. Thus, according to this embodiment, an A/F servo control employing the A/F as a target reference for engine control is performed when $\theta ac > 0$ and a speed servo control employing the engine speed N as a target reference is performed when $\theta ac = 0$.

FIGS. 7 and 9 are the block diagrams respectively showing the A/F servo controller and the speed servo controller.

It is to be noted that the construction of FIG. 7 may be realized with a wired logic in place of the control circuit 10.

In FIG. 7, target reference setting means 1 establishes A/F patterns corresponding to the driver's preferences, i.e., "sporty", "comfortable" and "economy" operating modes by using, as parameters, the whole range of throttle valve openings $\theta th$ serving as the substitute values for the loads and the variation rates $\dot{\theta}ac$ of accelerator pedal angle $\theta ac$.

The three different A/F patterns are stored in the form of three-dimensional maps in the RAM 116 of FIG. 2 and they can selectively be selected by a selection signal PT from the A/F pattern selection switch 174 in FIGS. 2 and 3.

As a result, when the driver selects one of the A/F patterns by the A/F pattern selection switch 174, the desired A/F or $(A/F)_R$ corresponding to the measured values $\dot{\theta}ac$ and $\theta th$ is read out from the map of the selected A/F pattern. This $(A/F)_R$ is applied as the target reference to predictive calculating means 2 to perform the combustion control of the engine 30.

The predictive computing means 2 calculates and outputs a fuel injection time $t_I$ in accordance with the intake air quantity $Q_a$ and the fuel injection quantity $Q_f$ as previously mentioned. The combustion result is obtained by predicting the timing at which the exhaust gas produced on the noted explosion cycle reaches the air-fuel ratio sensor, synchronizing this timing in terms of a crank angle and measuring the value of $(A/F)_A$. If $(A/F)_R$, the predictive calculating means 2 performs an action (e.g., a PID action) to correct the deviation $((A/F)_R-(A/F)_A)$.

Since it is conceivable that the operating environment (altitude, atmospheric pressure, temperature, etc.) and the characteristics of the engine change gradually over a long period of time, the corresponding adaptive controls are performed on the target reference setting means 1 and the predictive calculating means 2 by target reference updating means 4 and predictive calculation updating means 5, respectively. The target reference updating means 4 evaluates whether the air-fuel ratio patterns are proper over the range of the various loads and operating conditions in terms of the driving performance and riding comfort as well a the actual driving data (the vibration, roughness, A/F, etc. during the driving) and then updates the air-fuel ratio patterns of the target reference setting means 1 on the basis of the evaluation results. This updating is effected at intervals of a long period.

When updating the air-fuel ratio patterns, for each of the operating modes, the optimum A/F value for the idling speed or the steady-state running is determined first and then on the basis of this value the optimum A/F for acceleration and deceleration operations are calculated in consideration of the continuity relating to the loads and speeds of the engine, thereby effecting the updating.

As the driving is continued in this way, the air-fuel ratio patterns are improved and also the adaptation to the aging of the engine and the operating environment (the road surface conditions and the wind and snow) is improved.

As described hereinabove, by measuring the data having bearing on the combustion in each cylinder, it is possible to identify the characteristics of each cylinder. The result of the identification can be best used in a predictive calculation of the next fuel injection duration of the same cylinder.

As a result, the predictive calculation updating means 5 observes the combustion result of each cylinder or each combustion result so as to update the parameters of the predictive calculating means 2 to follow and maintain the desired A/F.

The updating of a predictive calculation model for the fuel injection quantity is effected such that the parameters of the predictive model for calculating the fuel injection quantity are changed with time so as to attain the required air-fuel ratio given by the air-fuel ratio pattern. While the data of every combustion in each cylinder is used in the adaptive correction of the predictive calculation model, Kalman filters or an exponential smoothing method is used to remove noise or instantaneous variations. In this way, only the gradually varying components can be extracted.

Also, in the case of the single-point injection method (SPI), the amount of liquid film deposited in the manifold and the amount of evaporation of the film are predicted so that the predicted values are additionally used in the calculation of fuel injection quantity and the propriety of the predicted values is adaptively corrected by the sensor for detecting the combustion result or the exhaust gas.

Figure 8A:
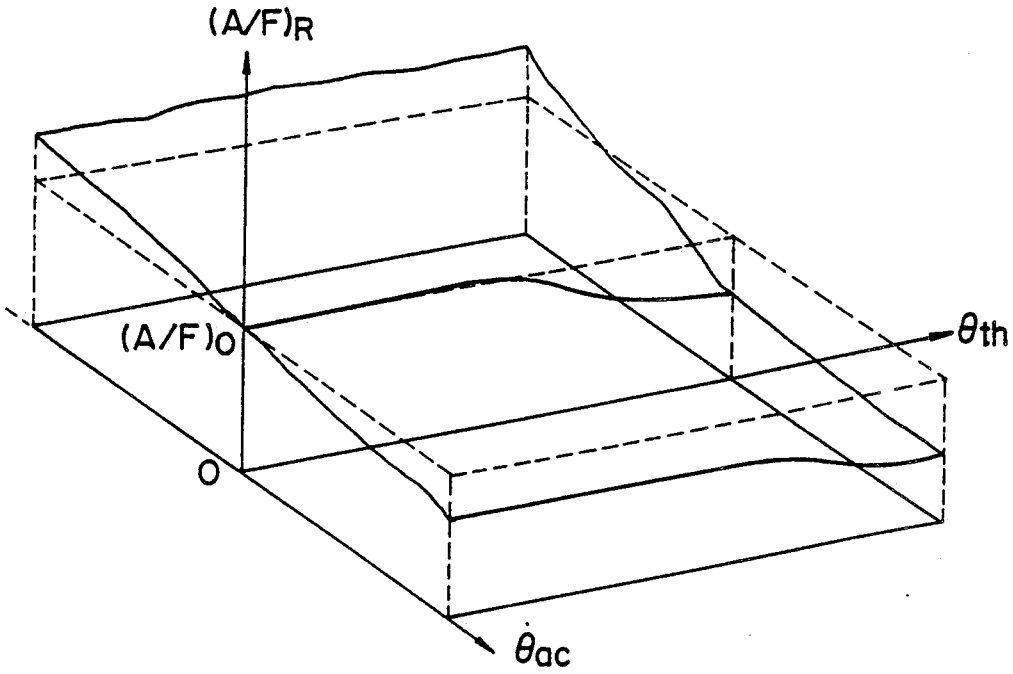
FIGS. 8A and 8B are diagrams showing examples of the air-fuel ratio patterns in the target reference setting section of FIG. 7.
Figure 8B:
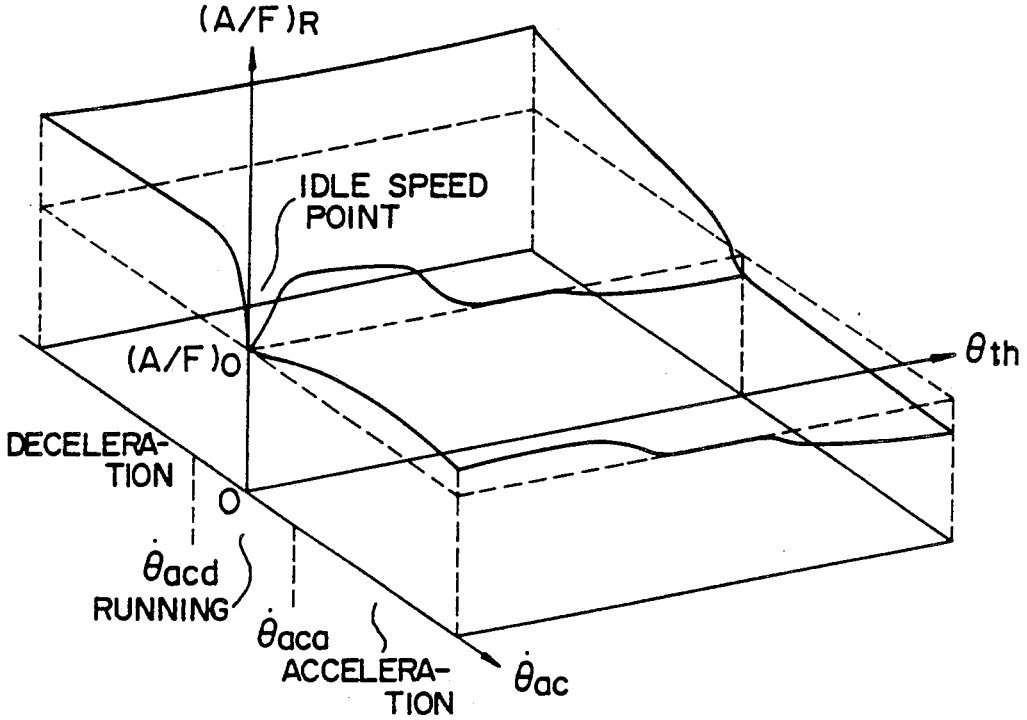

FIGS. 8A and 8B show two examples of the air-fuel ratio patterns in the target reference setting means 1, which correspond to the "sporty" and "economy" operating modes, respectively. The desired air-fuel ratios $(A/F)_R$ are shown as a function of the throttle valve openings $\theta th$ and the acceleration rates $\dot{\theta}ac$ in the form of a three-dimensional map. Represented by $\dot{\theta}ac>0$ is an acceleration region and represented by $\dot{\theta}ac<0$ is a deceleration region. Represented by $\theta ac=0$ is a steady-state running region. In each of the Figures, the ordinate represents a case where $\dot{\theta}ac=0$ and $\theta th=0$ and this corresponds to the non-depressed accelerator condition $\theta ac=0$. In this case, the idle speed control or the fuel cut-off control is performed as will be described later. In the Figures, the desired values for the idling operation are shown. Where the operating mode is the sporty mode as shown in FIG. 8A, the values are set so as to enrich the fuel in consideration of the driveability during the acceleration period. Where the operating mode is the "economy" mode as shown in FIG. 8B, it is desirable to decrease the amount of fuel or use a lean mixture. During the idling period, however, the stoichiometric air-fuel ratio is used as the target reference to prevent the engine from stopping. Also, during high-load and high-speed operations, the ratio is adjusted slightly richer in consideration of the acceleration performance.

The foregoing corresponds to the condition ($\theta ac>0$) where the accelerator pedal is depressed by the driver. In the non-depressed accelerator condition ($\theta ac=0$), either of the fuel cut-off control and the idle speed control is performed.

Referring to FIG. 9, there is illustrated the construction of a speed servo controller for performing the fuel cut-off control and the idle speed control. In the speed servo controller, intake air flow control means 7 and fuel quantity control means 8 come into operation so as to maintain the engine speed N (the number of revolutions per unit time) of the engine 30 at its desired value or $N_{IDL}$.

While there are mechanical upper and lower limits, the intake air flow control means 7 controls the intake air flow $Q_a$ through the idle speed control valve 48 in proportion to an engine speed deviation e. The fuel quantity control means 8 predictively calculates a fuel quantity $Q_f$ (specifically a fuel injection duration $t_I$) corresponding to the air flow $Q_a$ to control the quantity of fuel injected.

When the load, e.g., the air conditioner increases, the desired engine speed value is increased by $\Delta N$. When the engine speed deviation e is smaller than a given value $-N_{FC}(N>>N_{IDL}+\Delta N)$, fuel cut-off discriminating means 6 opens a path 3 between the control means 8 and the engine 30 to stop the supply of the fuel quantity $Q_f$ to the engine 30.

The predictive calculation model for the fuel quantity $Q_f$ of the fuel quantity control means 8 is updated by predictive calculation updating means 9, thereby maintaining the stability and follow-up or response of the control system with respect to changes of the environment and the engine characteristics with time.

Next, the operation of the embodiment, particularly the operations of the servo controllers shown in FIGS. 7 and 9 will be described with reference to the flow charts shown in FIGS. 10 to 12.

Figure 10:
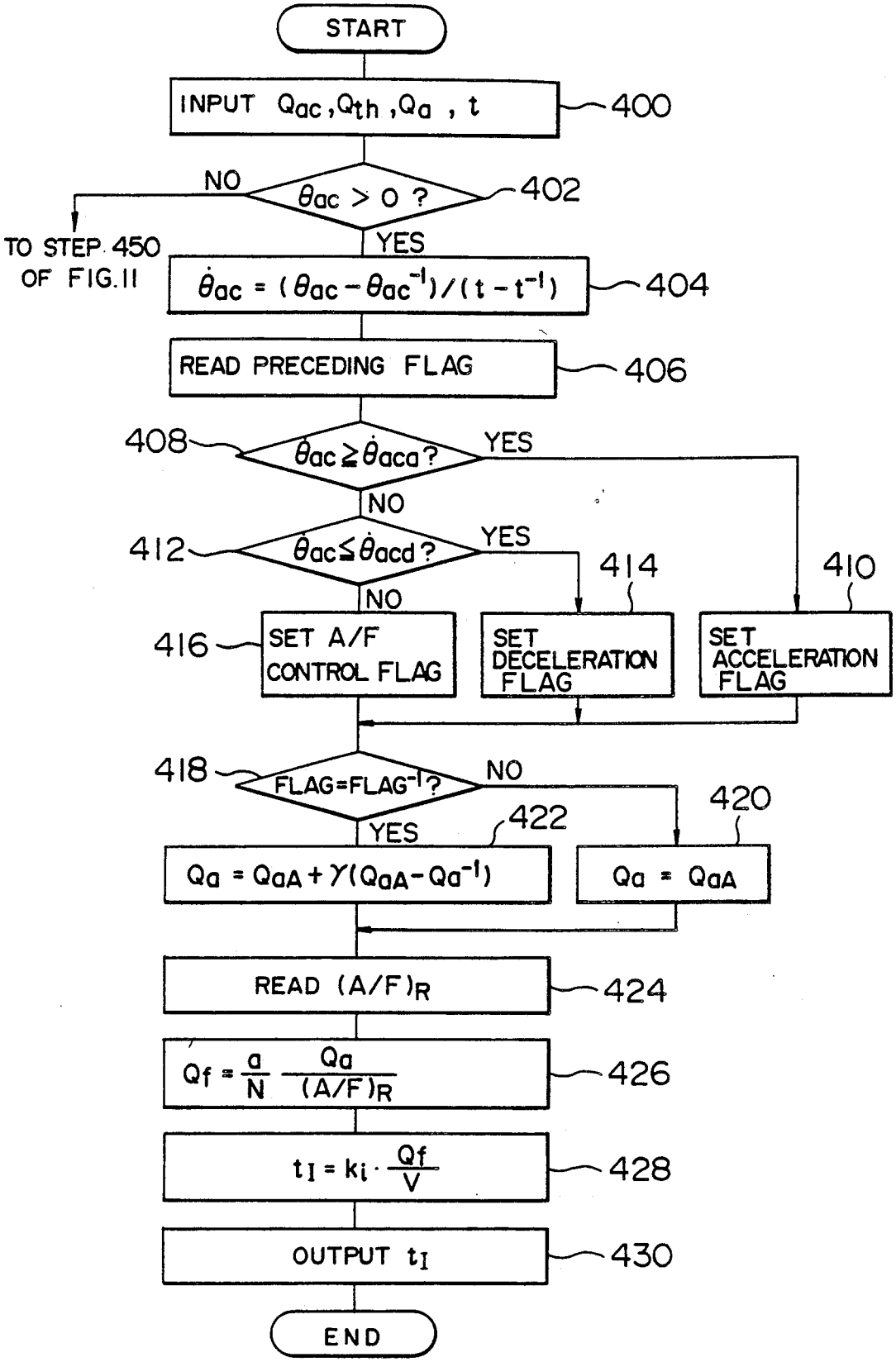
FIG. 10 is a flow chart for explaining the A/F servo control in the first embodiment of the invention.
Figure 11:
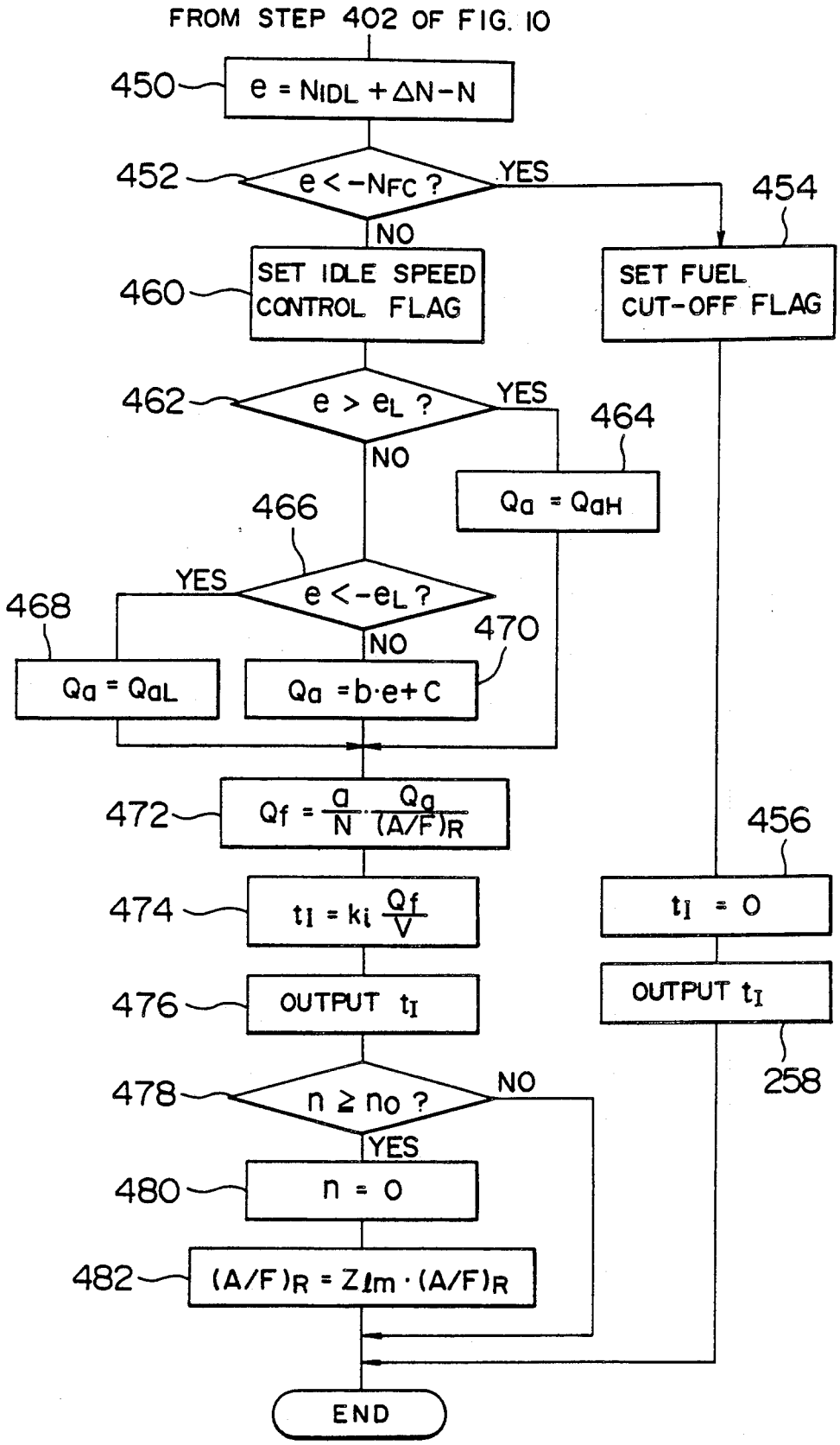
FIG. 11 is a flow chart for explaining the engine speed servo control in the first embodiment of the invention.

FIG. 10 shows the flow chart for explaining the operation of the A/F servo controller of the embodiment shown in FIG. 7, and FIG. 11 shows the flow chart for explaining the operation of the engine speed servo controller of FIG. 9. FIG. 12 shows the flow chart for explaining the operations of the target reference updating means and the predictive calculation updating means shown in FIGS. 7 and 9.

The flow chart of FIG. 10 is started at the timing of the step 304 in FIG. 5. Firstly, at a step 400, the data values $\theta_{ac}$, $\theta_{th}$ and $Q_a$ are respectively input from the sensors 23, 24 and 14 and the time t of the soft timer E in the RAM is read to store it in the RAM.

At a step 402, it is determined whether $\theta_{ac}>0$ so that if it is, a transfer is made to a step 404 where an A/F servo control is performed. On the contrary, if $\theta_{ac}=0$, a transfer is made to a step 450 of FIG. 11 where an engine speed servo control is performed.

At the step 404, an acceleration rate $\dot{\theta}_{ac}$ is calculated. In other words, the calculation of $\dot{\theta}_{ac}=(\theta_{ac}-\theta_{ac}^{-1})/(t-t^{-1})$ is effected according to the previously read accelerator pedal angle $\theta_{ac}^{-1}$, the currently read accelerator pedal angle $\theta_{ac}$, the previously read time $t^{-1}$ and the currently read time t.

At a step 406, the preceding flag ($Flag^{-1}$) stored in the RAM is read.

At a step 408, it is determined whether the value of $\dot{\theta}_{ac}$ obtained at the step 404 is greater than a minimum acceleration rate $\theta_{aca}$ for acceleration operation. If it is or YES, it is determined that the current operating condition is an accelerating condition (corresponding to the acceleration control [1] of FIG. 6) and an acceleration flag is set as the desired flag in the RAM (step 410).

At a step 412, it is determined whether the value of $\dot{\theta}_{ac}$ determined at the step 404 is smaller than a maximum acceleration rate $\dot{\theta}_{acd}$ for deceleration. If it is, it is determined that the current operating condition is a deceleration operation (corresponding to the deceleration control [2] of FIG. 6) and a deceleration flag is set as the desired flag in the RAM (step 414). On the contrary, if it is not or NO, a cruising condition (corresponding to the A/F control [4] of FIG.6) is determined and an A/F control flag is set in the RAM (step 416).

At a step 418, it is determined whether there is the equality between the current flag set at the step 410, 414 or 416 and the preceding flag read at the step 406. If it is not, it is determined that the operating condition has changed from one to another and the measured value of the intake air flow $Q_a$ input at a step 420 (hereinafter referred to as $Q_{aA}$) is set as a predicted intake air flow. Note that the value of $Q_a$ may be changed each time a transition occurs from one operating condition to another.

On the contrary, if there is the equality, a predicted intake air flow $Q_a$ is calculated in the following manner from the preceding intake air flow $Q_a^{-1}$, the intake air flow measured value $Q_{aA}$ and a constant $\gamma$, $\gamma$ is a filtering coefficient for measurements made by using a Kalman filter or the exponential smoothing method.

$$Q_a=Q_{aA}+\gamma(Q_{aA}-Q_a^{-1})$$

The reason is that the change $(Q_{aA}-Q_a^{-1})$ of $Q_a$ is assumed to continue and thus a predicted value of the change or $\gamma(Q_{aA}-Q_a^{-1})$ is added to the current measured value $Q_{aA}$, thereby calculating the value of $Q_a$.

At a step 424, the desired value $(A/F)_R$ is read in accordance with the values of $\dot{\theta}_{ac}$ and $\theta_{th}$ from the selected A/F pattern map.

At a step 426, a fuel injection quantity $Q_f$ is calculated from the following equation in accordance with the value of $Q_a$ determined at the step 420 or 422 and the value of $(A/F)_R$ obtained at the step 424. Here, a is a given coefficient.

$$Q_f=\frac{a}{N}\ \frac{Q_a}{(A/F)_R}$$

At a step 428, a fuel injection duration $t_I$ is calculated from the following equation.

$$t_I=k_i\cdot\frac{Q_f}{V}$$

Here, $Q_f$ represents the value obtained at the step 426 and V represents the volume velocity (constant) of the injected fuel which is dependent on the fuel injector. A correction factor $k_i+1$ of the ith cylinder, determined at a step 492 of FIG. 12, is used for $k_i$.

The thus determined $t_I$ is output as the value of the step 304 in FIG. 5. The steps 400 to 426 correspond to the blocks 1 and 2 in FIG. 7.

When $\theta_{ac}=0$ is determined at the step 402 of FIG. 10, transfer is made to the step 450 of FIG. 11 so that the engine speed servo control is performed.

At the step 450, a given idle speed $N_{IDL}$ is read from the RAM and a check is made in accordance with the output signal SAC from the air conditioner switch 176 to see if the air conditioner is in operation. Also, the engine speed N determined at the step 312 of FIG. 5 is read, thereby making the following calculation.

$$e=N_{IDL}+\Delta N-N$$

Note that the addition of $\Delta N$ is not made if the air conditioner is not in operation.

At a step 452, a check is made as to whether the value of e is smaller than the given value $-N_{FC}$. If it is, it is determined that the operating condition is a fuel cut-off operation (corresponding to the fuel cut-off control [3] of FIG. 6) and a fuel cut-off flag is set as the desired flag in the RAM (step 454). Then, at a step 456, $t_I=0$ is set and at a step 458 its value is output as the output of the step 304 of FIG. 5. This corresponds to the opening of the path 3 in FIG. 9.

On the contrary, if $e\geqq-N_{FC}$ is determined at the step 452, a transfer is made to a step 460 where it is determined that the operating condition is an idle speed control condition (corresponding to the control of FIG. 6)

and an idle speed control flag is set as the flag in the RAM.

Then, at a step 462, it is determined whether $e > e_L$. If $e > e_L$, as shown by the block 7 of FIG. 9, the intake air flow $Q_a$ is set to a given maximum intake air flow $Q_{aH}$ for idling operation. As a result, the idling speed control valve 48 is opened fully.

On the contrary, if $e \leqq e_L$, a transfer is made to a step 466 where it is determined whether $e < -e_L$. If it is, the intake air flow $Q_a$ is set to a given minimum intake air flow $Q_{aL}$ for idling operation (step 468). Thus, the idle speed control valve 48 is closed fully.

If $-e_L \leqq e \leqq e_L$, a transfer is made to a step 470 where the intake air flow $Q_a$ is calculated from the following equation.

$$Q_a = b \cdot e + C$$

where b represent the slope of the straight line connecting $-e_L$ and $e_L$ in the block 7 of FIG. 9, and C represents the intake air flow value at the intersection of the straight line and the ordinate. Thus, the opening of the idle speed control valve 48 is adjusted to attain this value of $Q_a$.

At a step 472, a fuel injection quantity $Q_f$ is calculated from the following equation in accordance with the value of $Q_a$ determined at the step 464, 468 or 470, the value of N and a given A/F value $(A/F)_R$ for idling operation.

$$Q_f = \frac{a}{N} \frac{Q_a}{(A/F)_R}$$

Then, at a step 474, a fuel injection duration $t_I$ is calculated from the following equation in the like manner as the step 428.

$$t_I = k_i \cdot \frac{Q_f}{V}$$

At a step 476, the value of $t_I$ is output as the output value of the step 304.

These steps 450 to 476 correspond to the blocks to 8 of FIG. 9.

Figure 12:
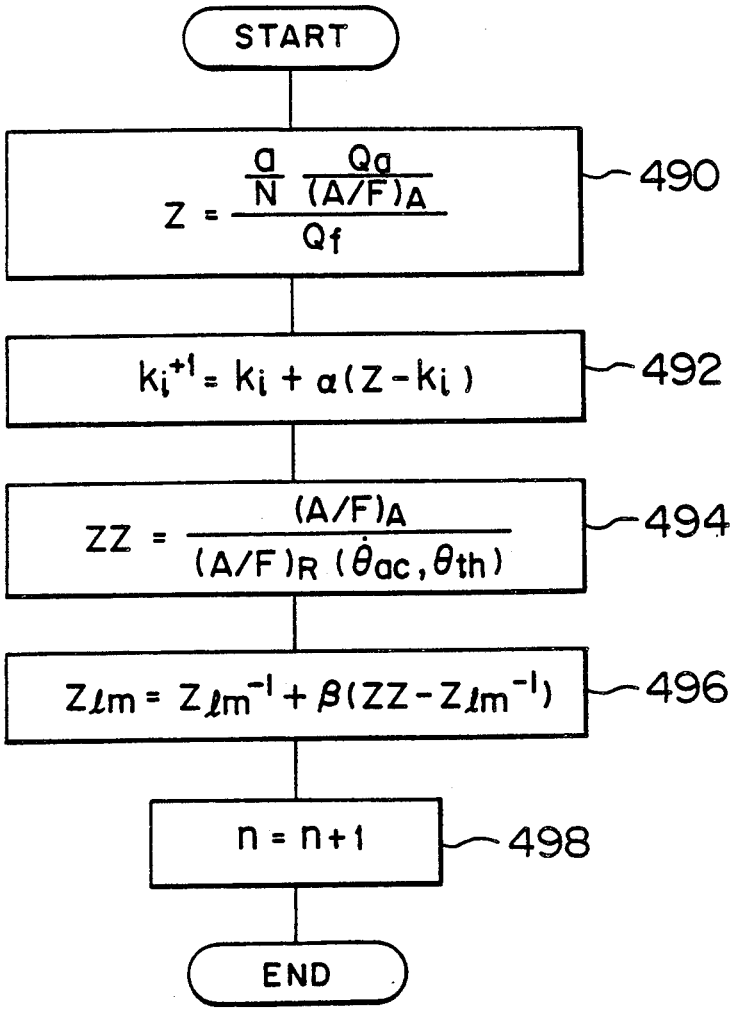
FIG. 12 is a flow chart for explaining the target reference updating and predictive calculation updating in the first embodiment of the invention.

At a step 478, a check is made as to whether the number of updating n of $Z_{lm}$ which will be described with reference to the flow chart of FIG. 12 is greater than a given number $n_o$.

If $n < n_o$, this flow is ended. If $n \geqq n_o$, $n = 0$ is set (step 480).

Then, at a step 482, the A/F desired values $(A/F)_R$ stored in the RAM are multiplied by the correction factor $Z_{lm}$ determined at a step 496 of FIG. 12 and the resulting values of $Z_{lm} \cdot (A/F)_R$ are set as new updated values $(A/F)_R$ of the A/F pattern map. In other words, thereafter the calculation of $Q_a$ is effected by using the updated new desired values $(A/F)_R$ of the A/F pattern map.

It is to be noted that the updating of the $(A/F)_R$ values is effected by using the corresponding correction factors $Z_{11}$ to $Z_{33}$ for the respective regions of the A/F pattern which is divided into 9 regions as will be described later.

The steps 478 to 482 correspond to the updating of the A/F patterns of the block 1 by the block 4 of FIG. 7.

Referring now to FIG. 12, the illustrated flow chart relating to the target reference updating and the predictive calculation updating will be described.

The flow chart of FIG. 12 shows in detail the step 317 of FIG. 5 and it is started at the timing of A/F measurement at the step 316.

Firstly, at a step 490, the combustion result of the i-th cylinder is measured in terms of $(A/F)_A$. A fuel injection quantity $$Q_{fA} = \frac{a}{N} \frac{Q_a}{(A/F)_A}$$

corresponding to the measured $(A/F)_A$ is compared with the value of $Q_f$ determined at the step 426 of FIG. 10 and the resulting deviation Z between the two is obtained as the ratio therebetween. In other words, the deviation Z is determined as follows $$Z = \frac{\frac{a}{N} \frac{Q_a}{(A/F)_A}}{Q_f}$$

It is to be noted that the deviation Z may also be calculated from the following equation.

$$Z = (A/F)_A - (A/F)_R$$

Then, at a step 492, a correction factor $k_i$ for the i-th cylinder is calculated from the following equation $$k_i^{+1} = k_i + \alpha(Z - k_i)$$

$\alpha$ and $\beta$ which will be described latter are filtering coefficients used in measurements employing Kalman filters or the exponential smoothing method, and the value of $\alpha$ is, for example, selected $0 < \alpha < 1.0$, preferably 0.3. Shown by $k_i$ is the value of the preceding correction factor for the i-th cylinder and represented by $k_i^{+1}$ is the correction factor which is to be used in the next calculation of $t_I$ for the i-th cylinder. The value of Z is the one determined at the step 490. Note that the initial value of $k_i$ is $(A/F)_A/(A/F)_R$.

The steps 490 and 492 correspond to the blocks 5 and 9 of FIGS. 7 and 9 and in this way the predictive calculation model of $t_I$ is updated.

Then, at a step 494, the deviation ZZ between the desired value $(A/F)_R$ of the A/F pattern map and the measured value $(A/F)_A$ is calculated from the following equation $$ZZ = \frac{(A/F)_A}{(A/F)_R}$$

where $(A/F)_R$ is the value read from the map in accordance with the measured data of $\dot{\theta}_{ac}$ and $\theta_{th}$.

Then, at the step 496, a correction factor $Z_{lm}$ for the A/F pattern map is calculated from the following equation $$Z_{lm} Z_{lm}^{-1} + \beta(ZZ - Z_{lm}^{-1})$$

In this case, the A/F pattern map is divided into 3 regions with respect to each of $\dot{\theta}_{ac}$ and $\theta_{th}$, that is, the map is divided into a total of 9 regions, and the correction factor $Z_{lm}$ is obtained for each of the regions. In other words, it is assumed that the suffixes l and m respectively indicate the following regions of $\dot{\theta}_{ac}$ and $\theta_{th}$.

| | | |
|---|---|---|
| Suffix $l$: | $l = 1$ | $\dot{\theta}_{ac} \geqq \dot{\theta}_{aca}$ |
| | $l = 2$ | $\dot{\theta}_{aca} > \dot{\theta}_{ac} > \dot{\theta}_{acd}$ |
| | $l = 3$ | $\dot{\theta}_{ac} \leqq \dot{\theta}_{acd}$ |
| Suffix $m$: | $m = 1$ | $\theta_{th} \geqq \theta_{th2}$ |
| | $m = 2$ | $\dot{\theta}_{th2} > \theta_{th} > \theta_{th1}$ |
| | $m = 3$ | $\theta_{th} \leqq \theta_{th1}$ |

Thus, for example, $Z_{11}$ (here $l=1$, $m=1$) is a correction factor for the A/F pattern map in the regions $\theta_{ac} \geqq \theta_{aca}$ and $\theta_{th} \geqq \theta_{th2}$.

In the above equation, $Z_{lm}^{-1}$ is the correction factor previously calculated and stored in the RAM, and $Z_{lm}^{-1}$ and $Z_{lm}$ are respectively the correction factors for the regions corresponding to the $\dot{\theta}_{ac}$ and $\theta_{th}$ in the calculation of ZZ at the step 494.

Then, at a step 498, the number of updating n of $Z_{lm}$ is increased by 1 and the resulting (n+1) is stored in the RAM. In this way, the correction factors $Z_{lm}$ for the map are continuously updated until $n \geqq n_o$ results. Then, when $n = n_o$ results as mentioned above ($n_o$ should preferably be several thousands), the desired values of the A/F pattern map are updated by the correction factors $Z_{lm}$.

These steps 494 to 498 and the steps 480 and 482 of FIG. 11 correspond to the block 4 in FIG. 7.

In accordance with the present invention, the macro and micro controls are separately performed by the target reference setting section and the control section and thus there is the effect of meeting requirements for the diversification of kinds of vehicles and simplifying the incorporation of control functions in modules. Since the updating of the target reference or the macro control can be effected for each of different operating conditions, it is possible to easily deal with changes in environment and vehicles with time. Also, the target references can be changed according to the driver's preference and thus it is possible to widely meet the preference of every driver or the driver's preference of the day. In addition, the target references can be updated according to the driver's preferences and thus personalization and peculiarization of vehicle control can be easily effected while meeting the laws and regulations.

In the control section, the desired values of A/F are supplied in categorized forms according to the various operating conditions so that it is only necessary to perform the required predictive calculations or controls for each category and therefore localized models can be used as the required control expressions. As a result, the desired functions can be realized by means of simple control expressions such as linear laws and this simplifies the matching of parameters.

Since the air and fuel drawn into each cylinder or during each combustion cycle and the resulting exhaust gas can be tracked and measured as the flow of clusters of gases in consideration of the delay in transfer of the gases, it is possible to grasp the combustion characteristics of every cylinder so as to correct any unbalance among the cylinders. This has the effect of reducing the occurrence of vibration and noise and improving the economy.

We claim:

1. An electronic control system for an internal combustion control engine comprising:

a plurality of first sensing means, such as an accelerator pedal position sensor, brake pedal position sensor and torque transmission mechanism sensor, for measuring a driver's action taken according to a driver's intention as to an immediate change in the operating condition of the vehicle and the engine;

a plurality of second sensing means, such as vehicle speed sensor, driveline torque sensor, and engine exhaust gas sensor, for measuring operating physical quantities of the vehicle;

a selecting means which classifies a driver's action according to outputs from said first sensing means, and which classifies the condition of said vehicle according to outputs from said second sensing means, to select one engine control operating condition from among a plurality of engine control operating conditions, such as idle control, acceleration control, deceleration control, fuel cut off control, and air-to-fuel ratio control;

a target reference setting means for selecting one among a plurality of target references in accordance with the engine control operating condition selected by said selecting means; and a control means for manipulating actuators for controlling said engine in response to the set target reference.

2. A system according to claim 1, wherein said target reference setting means sets a range of values of the target reference in accordance with the measured driver's intent and the conditions of the vehicle.

3. A system according to claim 1, wherein said control means calculates and supplies manipulating values to said actuators such that said engine attains the set target reference.

4. A system according to claim 1, wherein said target reference setting means sets an air-fuel ratio as said target reference when the selected operating condition of said engine is any one of acceleration control, deceleration control and A/F control and sets an engine speed as said target reference when the selected operating condition is either of idle speed control and fuel cut-off control.

5. A system according to claim 4, wherein said plurality of first sensors includes an accelerator pedal position sensor for detecting an accelerator pedal position indicative of said driver's intent, said target reference setting means sets an air-fuel ratio as said set target reference when it is determined according to an output of said accelerator pedal position sensor that an accelerator pedal is depressed and sets a desired value of engine speed as said selected target reference when it is determined that said accelerator pedal is not depressed.

6. A system according to claim 1, wherein said second sensing means further comprises means for measuring operating physical quantities of the engine, such as engine speed sensor, exhaust gas sensor, intake air flow sensor and engine temperature sensor, and wherein said second discriminating means further identifies the condition of said engine.

7. A system according to claim 2, wherein said target reference setting means sets a range of values of the target reference in accordance with the measured driver's intent, the conditions of the vehicle and a driver's preference.

8. A system according to claim 3, wherein said control means calculates the manipulating values of said actuators in accordance with at least one predictive calculation model selected among a plurality of predictive calculation models according to the set target reference.

9. A system according to claim 8, wherein when said selecting means selects as the selected operating condition of said engine any one of acceleration control, deceleration control and cruising control in accordance with an output from at least one of said first and second sensors, said control means predicts an intent of said driver for engine operation in accordance with a change in the output of said at least one sensor to determine manipulating values for said actuators in accordance with said predictive calculation model based on said prediction.

10. A system according to claim 8, wherein said control means updates said predictive calculation model according to outputs of said second sensors.

11. A system according to claim 8, wherein said second sensors include an intake air flow sensor for measuring a rate of intake air flow and said predictive calculation model includes a predicted value of intake air flow, whereby when the operating condition selected by selecting means does not change, said predicted value is calculated on the basis of a plurality of measured values of said intake air flow sensor on the assumption that variation of said intake air flow continues until the next combustion cycle.

12. A system according to claim 11, wherein when the operating condition selected by said selecting means does not change, a measured value of intake air flow on a current combustion cycle is selected as said predicted value of intake air flow in said predictive calculation model.

13. A system according to claim 8, wherein said first sensors include an accelerator pedal position sensor for detecting a position of an accelerator pedal, said second sensors include a sensor for measuring a load on said engine, and an intake air flow sensor for measuring a rate of intake air flow, and said actuators include at least one fuel injector, said target reference setting means determines a desired value of air-fuel ratio in accordance with a rate of change of the accelerator pedal position and a value indicating the engine load, said control means determines a predicted value of intake air flow in accordance with a change of a measured value of intake air flow measured by said intake air flow sensor to thereby calculate a fuel injection quantity as said manipulating value from said predictive calculation model according to said predicted value and then supplies the same to said fuel injector to attain said determined desired value of air-fuel ratio.

14. A system according to claim 8, wherein said target reference setting means updates said target reference, and said control means also updates said predictive calculation model.

15. A system according to claim 14, wherein said target reference setting means updates said target references for each of said operating conditions of said engine in accordance with long-term measured results of output data of said first and second sensors.

16. A system according to claim 14, wherein said control means updates said predictive calculation model in accordance with short-term measured results of output data of said first and second sensors.

17. A system according to claim 14, further comprising measuring means for measuring combustion results of fuel from outputs of said second sensors to obtain said measured results, said control means updates correction factors of said predictive calculation model in accordance with said measured results, and said target reference setting means updates said set target reference in accordance with said measured results.

18. A system according to claim 14, wherein said target reference setting means updates said set target reference in accordance with a deviation between a reference value indicated by said measured results and a value of said set target reference, and said control means updates a correction factor of said predictive calculation model in accordance with a deviation between a reference value indicated by said measured results and a value of said set target reference.

19. A system according to claim 8, wherein said actuators include at least one fuel injector, and said predictive calculation model is one for predictive calculation of a fuel injection quantity for attaining said value of said set target reference.

20. A system according to claim 8, wherein said actuators include ignition plugs, and said predictive calculation model is one for predictive calculation of ignition timings for said ignition plugs for attaining said value of said set target reference.

21. A system according to claim 8, wherein said control means is responsive to the combustion results of each said cylinder to update correction factors of said predictive calculation model for each said cylinder.

22. A system according to claim 17, wherein said measuring means measures said combustion results in such a manner that measurements are made in synchronism with given rotational angles of a crankshaft of said engine in consideration of time delays of measuring timings due to the flow of clusters of intake air, fuel and exhaust gas having bearing on the combustion in each cylinder and sensor positions for measuring said clusters of gases for each said cylinder so as to track and measure said clusters of gases and thereby measure combustion results for each said cylinder.

* * * * *